US008013546B2

(12) United States Patent
Bermuth et al.

(10) Patent No.: US 8,013,546 B2
(45) Date of Patent: Sep. 6, 2011

(54) BETATRON WITH A VARIABLE ORBIT RADIUS

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 287 days.

(21) Appl. No.: 12/431,554

(22) Filed: Apr. 28, 2009

(65) Prior Publication Data

US 2009/0267542 A1 Oct. 29, 2009

Related U.S. Application Data

(63) Continuation of application No. PCT/EP2007/007764, filed on Sep. 6, 2007.

(30) Foreign Application Priority Data

Oct. 28, 2006 (DE) ..... 10 2006 050 947

(51) Int. Cl.
*H05H 11/00* (2006.01)

(52) U.S. Cl. ..... 315/504; 378/57

(58) Field of Classification Search ..... 315/500, 315/501, 504; 378/57, 121, 143
See application file for complete search history.

(56) References Cited

U.S. PATENT DOCUMENTS

| | | | | |
|---|---|---|---|---|
| 2,447,255 | A | 8/1948 | Kerst et al. | |
| 2,480,169 | A * | 8/1949 | Westendorp | 315/500 |
| 2,510,448 | A * | 6/1950 | Wideroe | 315/15 |
| 2,533,859 | A * | 12/1950 | Wideroe | 315/504 |
| 2,538,718 | A * | 1/1951 | Wideroe | 315/504 |
| 2,546,484 | A * | 3/1951 | Wideroe | 315/507 |
| 2,572,414 | A * | 10/1951 | Wideroe | 315/504 |
| 2,572,551 | A * | 10/1951 | Wideroe | 315/15 |
| 2,631,234 | A * | 3/1953 | Wideroe | 315/504 |
| 2,675,470 | A * | 4/1954 | Wideroe | 315/504 |
| 2,738,421 | A * | 3/1956 | Westendorp | 315/500 |
| 3,614,638 | A * | 10/1971 | Ananiev et al. | 315/504 |
| 3,975,689 | A * | 8/1976 | Geizer et al. | 315/504 |
| 4,392,111 | A * | 7/1983 | Rostoker | 315/504 |
| 5,065,418 | A | 11/1991 | Bermbach et al. | |
| 6,201,851 | B1 * | 3/2001 | Piestrup et al. | 378/121 |

FOREIGN PATENT DOCUMENTS

| | | |
|---|---|---|
| DE | 2 357 128 | 5/1974 |
| DE | 23 57 126 A1 | 5/1975 |
| EP | 0 412 190 A1 | 2/1991 |
| EP | 0 481 865 A1 | 4/1992 |
| GB | 646 197 | 11/1950 |
| GB | 709390 | 5/1954 |
| GB | 1 398 694 | 6/1975 |

* cited by examiner

*Primary Examiner* — Thuy Vinh Tran
(74) *Attorney, Agent, or Firm* — Muncy, Geissler, Olds & Lowe, PLLC

(57) ABSTRACT

A betatron, especially for an X-ray testing apparatus is provided that includes a rotationally symmetrical inner yoke having two interspaced parts, at least one round plate that is arranged between the inner yoke parts in such a way that the longitudinal axis thereof coincides with the rotational symmetrical axis of the inner yoke, an outer yoke connecting the two inner yoke parts, at least one main field coil, a toroidal betatron tube arranged between the inner yoke parts, at least one tune coil in the region of the at least one round plate, and an electronic control system for controlling a current flow through the tune coil during the injection phase of the electrons into the betatron tube.

5 Claims, 6 Drawing Sheets

BETATRON WITH A VARIABLE ORBIT RADIUS

This nonprovisional application is a continuation of International Application No. PCT/EP2007/007764, which was filed on Sep. 6, 2007, and which claims priority to German Patent Application No. 10 2006 050 947.1, which was filed in Germany on Oct. 28, 2006, and which are both herein incorporated by reference

BACKGROUND OF THE INVENTION

1. Field of the Invention

The present invention relates to a betatron with a variable orbit radius, particularly for producing x-radiation in an x-ray inspection system.

2. Description of the Background Art

X-ray inspection systems are used, as is well-known, in the inspection of large-volume articles such as containers and motor vehicles for illegal contents such as weapons, explosives, or contraband goods. In so doing, x-radiation is produced and directed at the article. The x-radiation attenuated by the article is measured by means of a detector and analyzed by an evaluation unit. Therefore, a conclusion can be reached on the nature of the article. This type of x-ray inspection system is known, for example, from European Pat. No. EP 0 412 190 B1, which corresponds to U.S. Pat. No. 5,065,418.

Betatrons are used to generate x-radiation with the energy of more than 1 MeV needed for the inspection. These are circular accelerators in which electrons are accelerated in an orbit. The accelerated electrons are guided onto a target, where upon impacting they produce Bremsstrahlung whose spectrum depends, inter alia, on the energy of the electrons.

A betatron disclosed in German Patent Application No. DE 23 57 126 A1 includes a two-part inner yoke, in which the front sides of both inner yoke parts face each other spaced apart. A magnetic field is produced in the inner yoke by means of two main field coils. An outer yoke connects the two inner yoke part ends distant from one another and closes the magnetic ring.

An evacuated betatron tube, in which the electrons to be accelerated circulate, is arranged between the front sides of the two inner yoke parts. The front sides of the inner yoke parts are formed in such a way that the magnetic field produced by the main field coil forces the electrons into a circular orbit and moreover focuses them onto the plane in which the orbit lies. To control the magnetic flux, it is prior in the art to arrange a ferromagnetic insert between the front sides of the inner yoke parts within the betatron tube.

The electrons are injected, for example, by means of a electron gun into the betatron tube and the current is increased by the main field coil and thereby the strength of the magnetic field. An electric field, which accelerates the electrons in their orbit, is produced by the changed magnetic field. The Lorentz force on the electrons increases similarly simultaneously with the magnetic field strength. As a result, the electrons are held on the same orbit radius. An electron moves in an orbit when the Lorentz force directed at the center of the orbit and the opposing centripetal force cancel each other. The Wideroe condition follows from this:

$$\frac{1}{2}\frac{d}{dt} < B(r_s) >= \frac{d}{dt}B(r_s)$$

-continued $$< B(r_s) >= \frac{1}{\pi \cdot r_s^2}\int_A \int B(r)dA$$

with

In this case, $r_s$ is the nominal orbit radius of the electron, A the area defined by the nominal orbit radius $r_s$, and $<B(r_s)>$ the magnetic field strength averaged over the area A.

According to German Patent Application No. DE 23 57 128 A1, another coil is arranged around the ferromagnetic insert, which is connected in series with the main field coil and accordingly supplied with current during the acceleration phase. A thyristor circuit achieves that the additional coil at the end of the acceleration phase changes the magnetic field in such a way that the Wideroe condition is no longer fulfilled and thereby the electrons are deflected from their nominal path onto the target.

The disadvantage of the prior-art betatron is the fact that only a small part of the electrons injected into the betatron tube is accelerated to the desired final energy and thus a high efficiency does not result.

SUMMARY OF THE INVENTION

It is therefore an object of the present invention to provide a betatron with an increased efficiency.

A betatron according to an embodiment of the present invention has a rotationally symmetric inner yoke of two spaced-apart parts, at least one round plate between the inner yoke parts, whereby the round plate is arranged such that the longitudinal axis thereof coincides with the rotational symmetry axis of the inner yoke, an outer yoke connecting the two inner yoke parts, at least one main field coil, a torus-shaped betatron tube arranged between the inner yoke parts, and at least one tune coil in the region of the at least one round plate. According to the invention, furthermore, control electronics are provided for controlling current flow through the tune coil during the injection phase of the electrons into the betatron tube.

The injection phase thereby comprises not only the time period of the injection of the electrons into the betatron tube, but at least in part also the subsequent phase in which the electrons still do not move in the desired nominal orbit.

In an embodiment of the invention, the connections of a tune coil are connected to one another via a sink and in at least one line a switch actuatable by the control electronics is arranged between the tune coil and the sink. The switch is, for example, a high-performance semiconductor switch such as an IGBT (insulated gate bipolar transistor). The sink is, for example, a resistor or a semiconductor current sink. A semiconductor current sink has the advantage that its strength and thereby the current flow through the tune coil can be controlled. With a closed switch, the tune coil and the sink form a circuit. A current flow results by which the tune coil removes energy, typically converted into heat via the sink, from the magnetic field in the round plates.

In an alternative embodiment of the invention, the connections of a tune coil are connected to a current or voltage source and in at least one line a switch actuatable by the control electronics is arranged between the tune coil and the current or voltage source. The switch is again, for example, a high-performance semiconductor switch such as an IGBT (insulated gate bipolar transistor). With a closed switch, a current is impressed in the tune coil and produces a magnetic field, which is superimposed on the magnetic field of the main field coils.

Due to the position of the tune coil in the region of the round plates, with a current through the tune coil the average magnetic field strength through the area defined by the nominal orbit radius changes, however, without causing a significant change in the magnetic field strength in the nominal orbit radius itself. This also applies to the derivatives of these parameters with respect to time. Therefore, the Wideroe condition changes, which during the current flow through the tune coil leads to an increased nominal orbit radius $r_s'$. $r_s'$ can be varied by adjusting the current flow within the tune coil circuit. In this regard, the increased nominal orbit radius $r_s'$ is advantageously closer to the injection radius than the nominal orbit radius $r_s$. As a result, a greater number of the injected electrons are "captured" and guided to an orbit. After the interruption of the current flow, the Wideroe condition is again fulfilled by the desired nominal orbit radius $r_s$ and the electrons enter this nominal orbit radius $r_s$.

Alternatively, the current flow through the tune coil is interrupted during the injection of the electrons. As a result, the nominal orbit radius $r_s'$ during the injection is reduced compared with the nominal orbit radius $r_s$ during the acceleration. This is necessary when the injection radius is smaller than the nominal orbit radius $r_s$, in which the electrons are accelerated; the electrons are therefore injected into an inner radius.

The opposing front sides of the inner yoke parts can be formed and arranged with mirror symmetry to one another. The symmetry plane in this regard is advantageously oriented so that the rotational symmetry axis of the inner yoke is perpendicular to it. This results in an advantageous field distribution in the air gap between the front sides by which the electrons in the betatron tube are kept in an orbit.

Furthermore, at least one main field coil can be arranged on the inner yoke, particularly on a neck or a shoulder of the inner yoke. This has the result that substantially the entire magnetic flux produced by the main field coil is guided through the inner yoke. In an advantageous manner, the betatron has two main field coils, a main field coil being arranged on each of the inner yoke parts. This leads to an advantageous distribution of the magnetic flux on the inner yoke parts.

In an embodiment of the invention, the tune coil can surround the outer circumference of at least one round plate. The round plate therefore fills substantially completely the interior of the tune coil. The advantage of this arrangement is that each winding of the tune coil reduces the magnetic field through the entire cross-sectional area of the enclosed magnetically active material of the round plate.

In another embodiment of the invention, the tune coil can be arranged between two round plates. This has the advantage of a reduced space requirement, because the tune coil does not extend beyond the circumference of the round plate. This also applies to another advantageous embodiment in which the tune coil is arranged between a round plate and the front side of an inner yoke part.

If the tune coil is arranged between two round plates or a round plate and the front side of an inner yoke part, then the tune coil can be formed, for example, in the form of a spiral. This results in smaller height of the tune coil and thereby in a smaller air gap between the round plates or the round plate and the front side of the inner yoke part.

The betatron of the invention is advantageously used in an x-ray inspection system for security inspection of objects. Electrons are injected into the betatron and accelerated, before they are guided to a target formed of, for example, tantalum. There, the electrons produce x-radiation with a known spectrum. The x-radiation is directed onto the object, preferably a container and/or a motor vehicle, and there modified, for example, by scattering or transmission attenuation. The modified x-radiation is measured by an x-ray detector and analyzed by means of an evaluation unit. A conclusion on the nature or the content of the object can be reached from the result.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
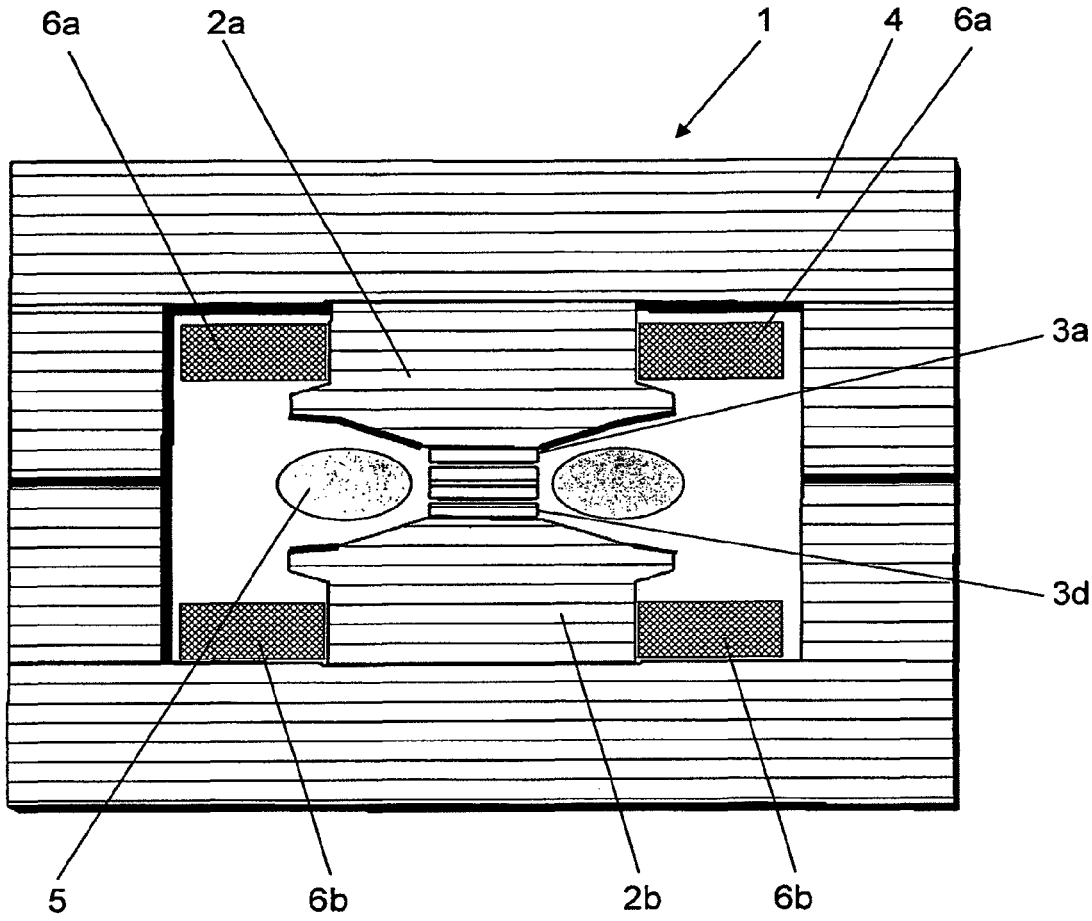
FIG. 1 shows a schematic sectional view through a betatron of the invention.

FIG. 1 shows a schematic structure of a betatron 1 in cross section. It includes, inter alia, of a rotationally symmetric inner yoke made up of two spaced-apart parts 2*a*, 2*b*, four round plates 3*a* to 3*d* between inner yoke parts 2*a*, 2*b*, whereby the longitudinal axis of the round plates 3*a* to 3*d* corresponds to the rotational symmetry axis of the inner yoke, an outer yoke 4 connecting the two inner yoke parts 2*a*, 2*b*, a torus-shaped betatron tube 5 arranged between inner yoke parts 2*a*, 2*b*, two main field coils 6*a* and 6*b*, and control electronics 8, which are not shown in FIG. 1. Main field coils 6*a* and 6*b* are arranged on shoulders of inner yoke parts 2*a* or 2*b*. The magnetic field produced by them penetrates the inner yoke parts 2*a* and 2*b*, whereby the magnetic circuit is closed by outer yoke 4. The shape of the inner and/or outer yoke can be selected by the person skilled in the art depending on the application and can deviate from the shape shown in FIG. 1. Only one or more than two main field coils may also be present. A different number and/or shape of the round plates are likewise possible.

Between the front sides of inner yoke parts 2*a* and 2*b*, the magnetic field runs partially through round plates 3*a* to 3*d* and otherwise through an air gap. Betatron tube 5 is arranged in said air gap. This is an evacuated tube in which the electrons are accelerated. The front sides of inner yoke parts 2*a* and 2*b* have a shape that is selected so that the magnetic field between them focuses the electrons in an orbit. The design of the front sides is known to the person skilled in the art and is therefore not explained in greater detail. At the end of the acceleration process, the electrons hit a target and thereby produce x-radiation whose spectrum depends, inter alia, on the final energy of the electrons and the material of the target.

For acceleration, the electrons are injected with an initial energy into betatron tube 5. During the acceleration phase, the magnetic field in betatron 1 is continuously increased by main field coils 6*a* and 6*b*. As a result, an electric field is produced that exerts an accelerating force on the electrons. At the same time, due to the Lorentz force, the electrons are forced into a nominal orbit within betatron tube 5.

The acceleration of the electrons is repeated periodically, which results in a pulsed x-radiation. In each period, in a first step the electrons are injected into betatron tube 5. In a second step, the electrons are accelerated by an increasing current in main field coils 6*a* and 6*b* and thereby an increasing magnetic field in the air gap between inner yoke parts 2*a* and 2*b* in the circumferential direction of its orbit. In a third step, the accelerated electrons are deflected onto the target to produce x-radiation. Then an optional pause follows before electrons are again injected into betatron tube 5.

Figure 2A:
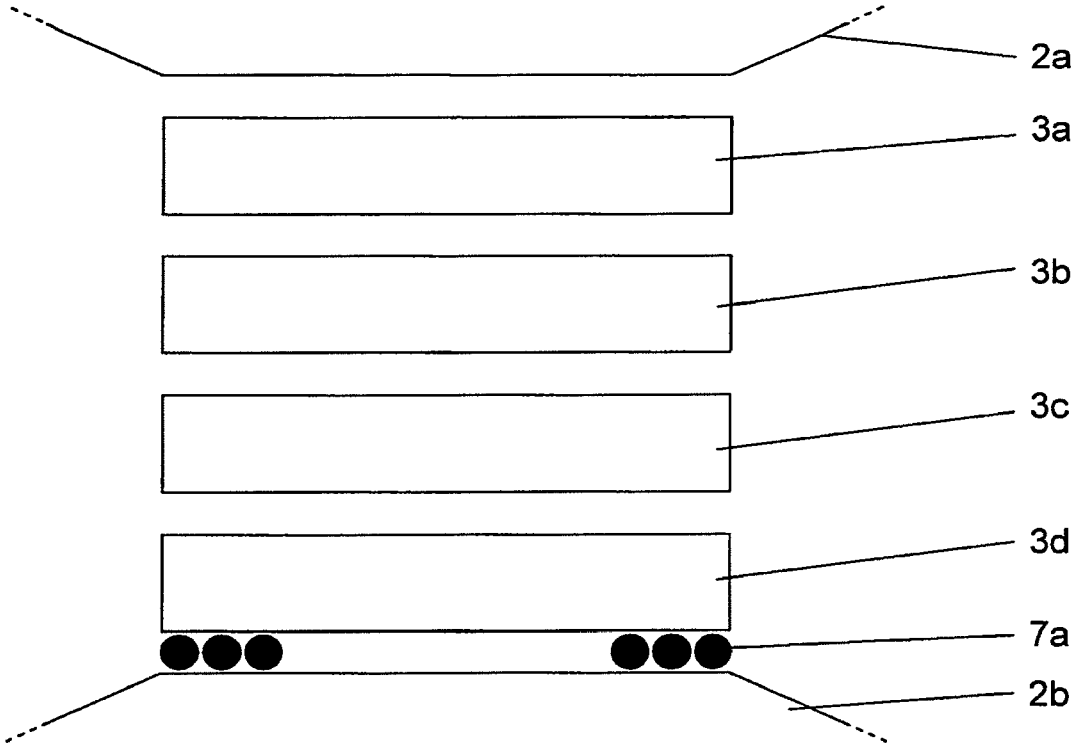
FIGS. 2*a* to 2*c* show an enlarged illustration of the round plate region of FIG. 1 with different tune coils.
Figure 2B:
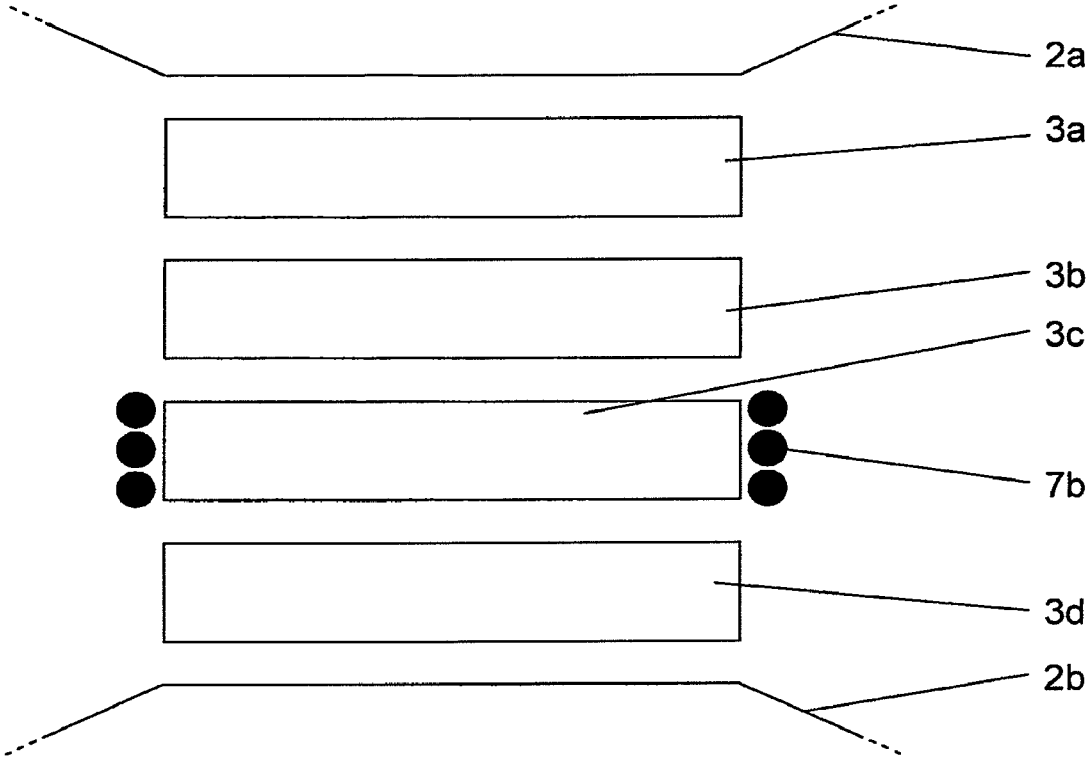
Figure 2C:
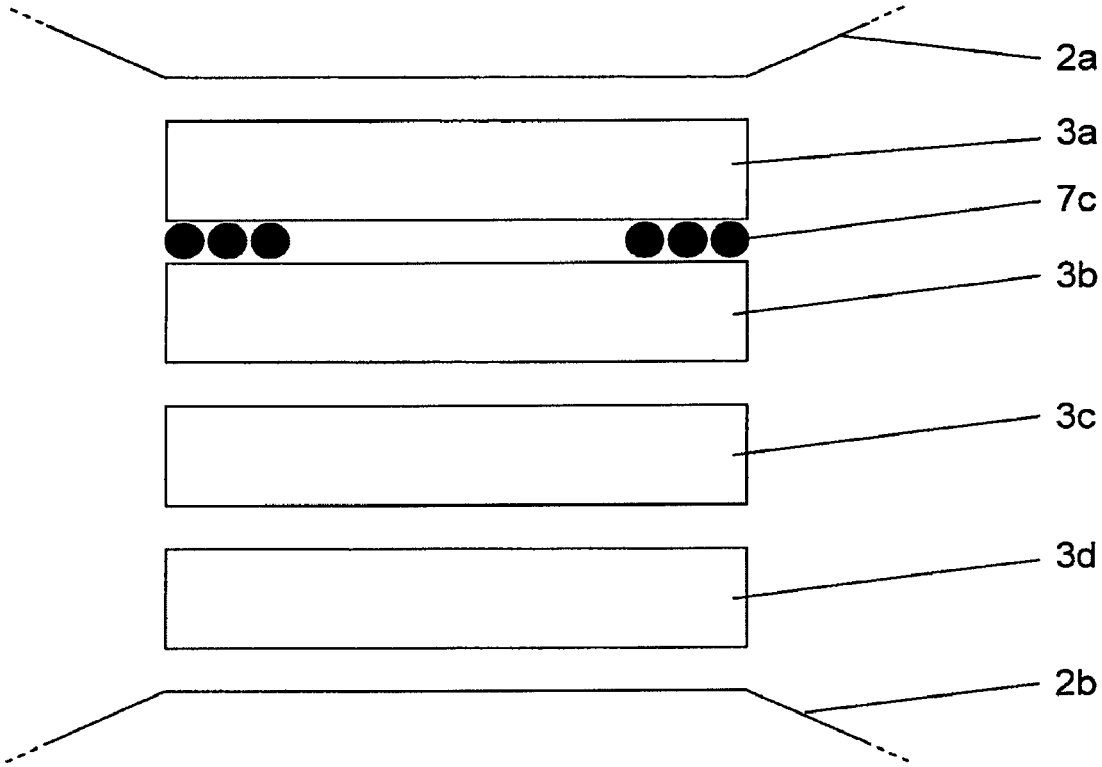
Figure 3:
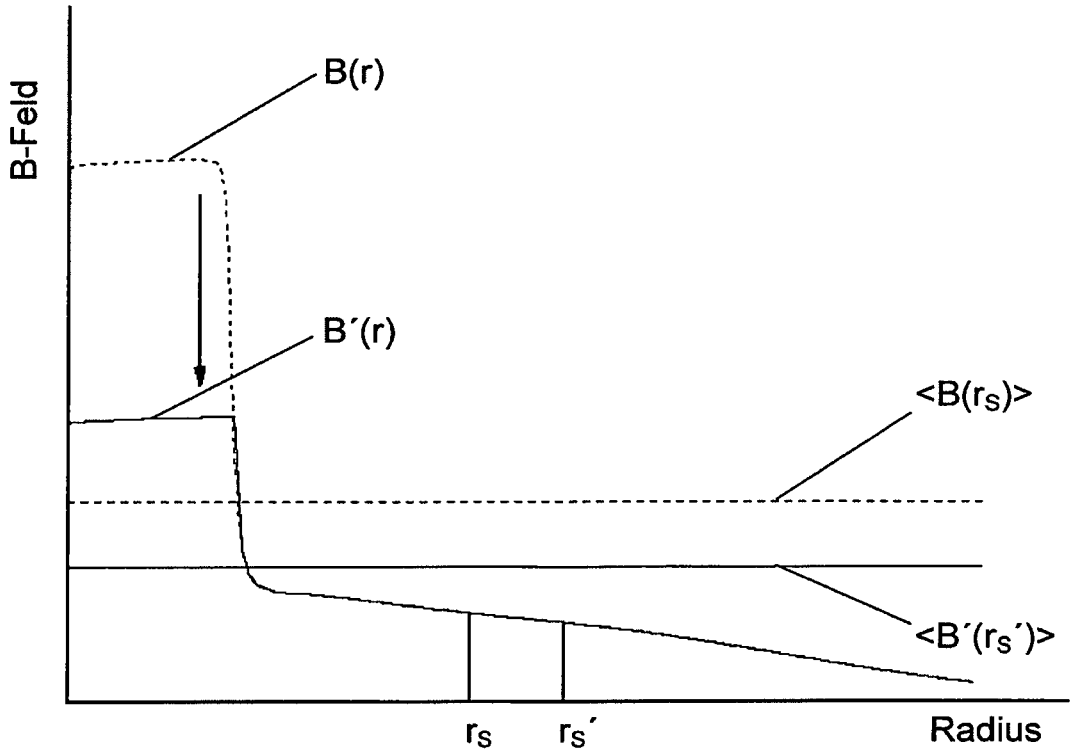
FIG. 3 shows a qualitative course of the magnetic field strength versus the radius.

FIGS. 2*a* to 2*c* show an enlarged detail of betatron 1 in the region of round plates 3*a* to 3*d* with different positions of a tune coil. An air gap and/or a nonmagnetizable material are arranged in each case between two neighboring round plates or an outer round plate 3*a*, 3*b* and an inner yoke part 2*a*, 2*b*. This results in the qualitative course of the magnetic field B(r) versus the radius, proceeding from the rotational symmetry axis of the inner yoke; this course is shown as a dashed line in FIG. 3. Because of the permeability of the round plate material, the magnetic field in the region of the round plates is stronger than in the air gap, without round plates, between the front sides of inner yoke parts 2*a* and 2*b*.

FIG. 2*a* shows an embodiment of the invention with a spirally wound tune coil 7*a* between round plate 3*d* and inner yoke part 2*b*. Tune coil 7*b* in FIG. 2*b*, in contrast, surrounds the outer circumference of round plate 3*c*, so that round plate 3*c* acts as an iron core of tune coil 7*b*. Tune coil 7*c* in FIG. 2*c* is wound spirally and arranged in the air gap between round plate 3*a* and round plate 3*b*. Tune coils 7*a* or 7*c* alternatively may have a different type of winding and extend, for example, in the longitudinal direction. The tune coils in FIGS. 2*a* to 2*c* are indicated by three windings; the actual design can deviate herefrom.

The number and arrangement of the tune coils are within the discretion of the person skilled in the art practicing the invention. In this case, it is possible to use an individual tune coil or any combination of coils and their position in the region of the round plates. A modified form of the tune coil is also possible, which both surrounds the circumference of a round plate and has an extension into a gap between two round plates or a round plate and an inner yoke part.

The aforementioned Wideroe condition applies to the path of the electrons in betatron tube 5, which results from the fact that the centripetal force offsets the Lorentz force. The broken horizontal line indicates the average magnetic field strength $<B(r_s)>$ through the area defined by the nominal orbit radius $r_s$. The radius $r_s$, which fulfills the equation $$\frac{1}{2}\frac{d}{dt} < B(r_s) >= \frac{d}{dt}B(r_s)$$

is the stable nominal orbit radius in which the electrons circulate.

Typically, the electrons are not injected into this stable nominal orbit radius in betatron tube 5, as a result of which only a small part of the injected electrons is forced into the orbit. According to the invention, therefore, during the injection phase, the aforementioned equilibrium condition is disturbed and thereby a changed nominal orbit radius $r_s'$ is achieved for this time period. In the present exemplary embodiment, the injection radius of the electrons is greater than the nominal radius during the acceleration.

The disturbance of the equilibrium condition is achieved by using a tune coil in the region of the round plates. A current through tune coils 7*a* to 7*c* is allowed by control electronics 8 during the injection phase. As a result, the magnetic flux in round plates 3*a* to 3*d* is weakened, whereas the current outside the round plates, therefore particularly in the region of betatron tube 5, has no notable effect on the magnetic flux.

In an embodiment of the present exemplary embodiment, a tune coil 7*a* to 7*c* is connected to a load resistor in each case via a switch, for example, a semiconductor power switch such as an IGBT. This is shown schematically in FIG. 4 for tune coil 7*a*. During the injection phase, control electronics 8 control the switch 9 in such a way that tune coil 7*a* is connected intermittently to load resistor 10. A current flow through the electric circuit and thereby also through tune coil 7*a* results, which causes a magnetic field within the area formed by the tune coil, particularly in round plates 3*a* to 3*d*. Therefore, the course B'(r) of the magnetic field strength versus the radius, as shown as a solid line in FIG. 3, results qualitatively as a superposition of the magnetic fields of main field coils 6*a*, 6*b* and tune coil 7*a*.

It becomes apparent that at a current flow through the tune coil the magnetic field strength in the air gap between inner yoke parts 2*a* and 2*b* and thereby their derivative with respect to time can hardly be affected, but declines considerably in the region of the round plates. As a result, the average field strength $<B(r_s)>$, indicated by a broken line in FIG. 3, through the area with the radius $r_s$ declines to the average field strength $<B'(r_s')>$, shown as a solid line, through the area with the radius $r_s'$. The derivative of these parameters with respect to time declines at the same time. The Wideroe condition is thereby fulfilled by a modified nominal orbit radius $r_s'$, which is greater than the radius $r_s$ and therefore lies closer to the injection radius of the electrons.

Figure 5:
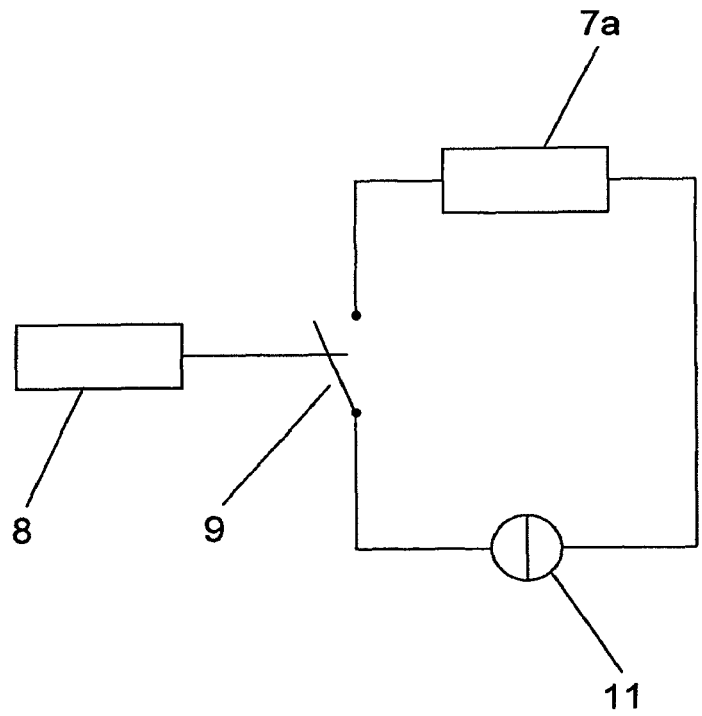
FIG. 5 shows a tune coil circuit with a voltage source.

In an alternative design of the present exemplary embodiment, tune coil 7*a* can be connected to a current source 11 via switch 9 as shown schematically in FIG. 5. If the switch is closed by control electronics 8 during the injection phase, a current is impressed in tune coil 7*a*. This current produces a magnetic field in round plates 3*a* to 3*d*, which is opposed to the magnetic field produced by main field coils 6*a*, 6*b* and weakens it. The effects on the magnetic field in the betatron and thereby the nominal orbit radius are the same as in the aforementioned alternative with a sink in the tune coil electric circuit.

Figure 4:
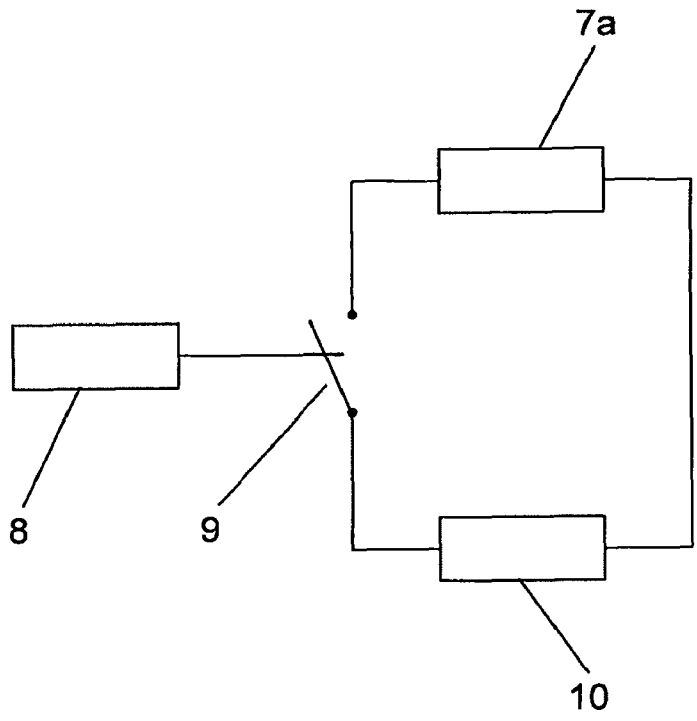
FIG. 4 shows a tune coil circuit with a sink.

FIGS. 4 and 5 show by way of example the electric circuits of tune coil 7*a*, which can be applied identically to tune coils 7*b* and 7*c*. Optionally, several tune coils are connected via one or more switches to a common resistor or a common voltage source. Furthermore, alternatively, each tune coil is connected via a separate switch to a resistor assigned to the tune coil or a voltage source assigned to the tune coil.

In an alternative embodiment, the tune coil is separated from the load resistor or the voltage source during the injection phase, and at all other times the connection is closed. As a result, the nominal orbit radius $r_s'$ during the injection becomes smaller than the radius $r_s$, in which the electrons are accelerated. This is advantageous when the electrons are injected into the region of the inner edge of betatron tube 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A betatron for an x-ray inspection system, the betatron comprising:

a rotationally symmetric inner yoke having two spaced-apart parts;

at least one round plate arranged between the inner yoke parts, the round plate being arranged so that a longitudinal axis thereof coincides with a rotational symmetry axis of the inner yoke;

an outer yoke connecting the two inner yoke parts;

at least one main field coil;

a torus-shaped betatron tube arranged between the inner yoke parts;

at least one tune coil arranged in a region of the at least one round plate; and control electronics configured to control current flow through the tune coil during the injection phase of the electrons in the betatron tube.

2. The betatron according to claim 1, wherein the opposing front sides of the inner yoke parts are formed and arranged with mirror symmetry to one another.

3. The betatron according to claim 1, wherein at least one main field coil is arranged on the inner yoke or on a neck or a shoulder of the inner yoke.

4. The betatron according to claim 3, further comprising two main field coils, wherein the main field coil is arranged on each inner yoke parts.

5. The betatron according to claim 1, wherein the connections of a tune coil are connected to one another via a sink and wherein, in at least one line, a switch actuatable by the control electronics is arranged between the tune coil and the sink.

* * * * *